United States Patent [19]

Kimura et al.

[11] Patent Number: 4,704,169

[45] Date of Patent: Nov. 3, 1987

[54] RAPIDLY QUENCHED ALLOYS CONTAINING SECOND PHASE PARTICLES DISPERSED THEREIN

[76] Inventors: Hiroshi Kimura, 5-9-36 Hachiman; Tsuyoshi Masumoto, 3-8-22 Kamisugi, both of Sendai-shi, Miyagi-ken, Japan

[21] Appl. No.: 530,229

[22] Filed: Sep. 8, 1983

[30] Foreign Application Priority Data

Sep. 8, 1982 [JP] Japan ..... 57-155143

[51] Int. Cl.[4] ..... C22C 1/10

[52] U.S. Cl. ..... 148/403; 420/901; 420/580; 428/614; 428/930

[58] Field of Search ..... 148/31, 31.55, 400, 148/403, 426, 432, 442; 428/614, 930; 420/580, 901

[56] References Cited

U.S. PATENT DOCUMENTS

| | | | |
|---|---|---|---|
| 4,116,687 | 9/1978 | Hasegawa | 148/403 |
| 4,182,628 | 1/1980 | D'Silva | 148/403 |
| 4,264,358 | 4/1981 | Johnson et al. | 148/403 |
| 4,268,564 | 5/1981 | Narasimhan | 75/0.5 R |
| 4,365,997 | 12/1982 | Jachowski et al. | 148/31 |
| 4,409,041 | 10/1983 | Datta et al. | 148/31.55 |

FOREIGN PATENT DOCUMENTS

| | | | |
|---|---|---|---|
| 49585 | 5/1981 | Japan | 420/901 |
| 158833 | 12/1981 | Japan | 148/403 |
| 108231 | 7/1982 | Japan | 148/31 |
| 55557 | 4/1983 | Japan | 148/403 |

*Primary Examiner*—L. Dewayne Rutledge
*Assistant Examiner*—Robert L. McDowell

[57] ABSTRACT

A composite rapidly quenched alloy material comprises a matrix composed of a rapidly quenched alloy, such as an amorphous or crystalline alloy, or a mixture thereof, and particles of at least one second-phase substance dispersed in the matrix uniformly and three-dimensionally.

1 Claim, 3 Drawing Figures

RAPIDLY QUENCHED ALLOYS CONTAINING SECOND PHASE PARTICLES DISPERSED THEREIN

BACKGROUND OF THE INVENTION

1. Field of the Invention

This invention relates to a composite material composed of a rapidly-quenched alloy matrix and particles of a second-phase substance dispersed therein.

2. Description of the Prior Art

The requirements for the properties and performance of metallic materials have recently become more stringent and versatile. A composite material is one of the possible solutions to these requirements. A typical composite material comprises a metal alloy phase and a second phase of particles dispersed therein. More specifically, Cu—C, Fe—BN, etc. are known as a material for making sliding parts, and WC—Co, WC—TiC—Co, etc. are known as ultrahard alloys. They are produced by powder metallurgy, and tend to be porous. There is a serious limitation to the shape of the material which can be produced by powder metallurgy. Powder metallurgy provides a uniform, three-dimensional dispersion of second-phase particles, but has the disadvantage of tending to create pores in the composite material. Although a composite material made by melting is substantially free from any such pore, the second-phase particles are not dispersed uniformly in the molten metal, but in many cases float towards its surface. The second phase is separated from the alloy phase, and the material cannot withstand a high mechanical stress. Various methods have been proposed to improve those problems, but none of them has been found capable of producing a composite material which is sufficiently strong against a mechanical stress.

SUMMARY OF THE INVENTION

It is an object of this invention to provide a composite material which eliminates the drawbacks of the material known in the art, and which is excellent in toughness and strength.

The inventors of this invention have succeeded in manufacturing a rapidly-quenched alloy containing a second phase of particles dispersed therein by employing the liquid quenching method which is known as a method of producing a rapidly-quenched alloy. They have found that the composite material possesses all of the advantages of its constituents, i.e., a rapidly-quenched alloy and second-phase particles.

According to this invention, there is provided a composite material comprising a rapidly-quenched alloy matrix composed of an amorphous or crystalline alloy or a mixture thereof, and a second phase of particles dispersed in the matrix uniformly and three-dimensionally.

DETAILED DESCRIPTION OF THE INVENTION

Figure 1:
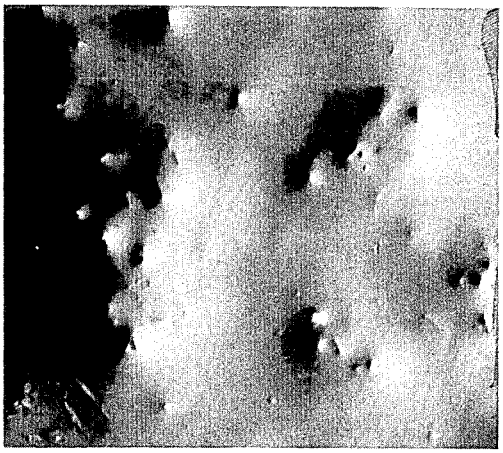
FIG. 1 is an electron micrograph showing the composition of a composite material embodying this invention.

The second phase in the composite material of this invention may be composed, for example, of a carbide, nitride, oxide, boride or silicide, or a composite thereof. They are generally higher in melting point, strength and electrical resistance than a metallic material, but are too brittle to withstand a high mechanical stress. A carbonaceous material is excellent in lubricating property against mechanical sliding. Therefore, it is possible to obtain a tough and strong composite material if an approriate combination of a rapidly-quenched alloy and a second phase of particles is employed. In other words, the composite material of this invention possesses both the high toughness of an amorphous or metastable alloy and the high strength of a second phase of particles. Moreover, it has a higher Young's modulus than that of any conventional rapidly-quenched alloy. The composite material of this invention has a very high strength in the interface between the rapidly-quenched alloy phase and the second phase of particles, since broken second-phase particles are found at the corresponding points of the fracture surfaces formed by a tensile test.

The inspection of the composite material of this invention by a scanning electron microscope, or the like reveals a uniform, three-dimensional dispersion of the second-phase particles in the rapidly-quenched alloy matrix, and also indicates that it is substantially free from any pore. This is apparently the reason why the material of this invention is excellent in toughness and strength.

The material of this invention may be produced by the liquid quenching method. This method is carried out in various modes for producing a rapidly-quenched alloy. For example, an alloy in ribbon form is produced by a single or double roll method, or a centrifugal method, and an alloy in wire form by a spinning method which employs a stream of water, a rotating solution or glass coating. If the alloy composition or the quenching rate is appropriately selected or controlled, the liquid quenching method enables the production of a metastable substance, such as an amorphous, or non-equilibrium crystalline phase, which does not appear in an equilibrium state diagram, as well as an equilibrium crystalline phase.

The amorphous alloys produced by the liquid quenching method are generally high in toughness, and higher in strength than the metallic materials in general. Some of them are excellent in soft magnetic property and corrosion resistance. They are useful for a wide range of applications, and are already employed in practice. The non-equilibrium crystalline alloys produced by the liquid quenching method are also superior in strength to the metallic materials in general. The liquid quenching method is also useful for producing a conventionally known alloy in the form of a thin sheet, for example, a Sendust or Fe-Si alloy in ribbon form.

The second phase of particles may be composed of carbon or a compound thereof such as WC, TiC or NbC, a nitride such as NbN or TaN, an oxide such as $ThO_2$, $Al_2O_3$, $Fe_2O_3$, ZnO or $SiO_2$, a boride such as BN, a silicide such as SiC, a metal such as Ti, Fe, Mo or W, or an alloy thereof, or a composite thereof.

The invention will now be described in further detail with reference to several examples thereof.

EXAMPLE 1

Composite materials of the following compositions were produced by the single-roll method:

$(Ni_{78}Si_{10}B_{12})_{97}(WC)_3$ $(Ni_{78}Si_{10}B_{12})_{92}(WC)_8$ $(Ni_{78}Si_{10}B_{12})_{82}(WC)_{18}$

In each formula, the first pair of parentheses show the rapidly-quenched alloy composition and the proportion of each element in atom %, while the second pair of parentheses indicate the second-phase substance. The second-phase substance, or WC had an average particle diameter of 1 μm. The proportions of the alloy and the WC particles are shown by volume % in each formula.

Each composite material was produced as will hereinafter be described. An alloy ingot was prepared by melting 459 g of Ni, 28 g of Si and 13 g of B in a vacuum, high-frequency induction apparatus. A part of this alloy and WC powder were weighed to provide the volume proportions expressed by each formula, and melted by high-frequency induction in the presence of argon gas in a quartz glass nozzle disposed immediately above a steel roll.

It was necessary to maintain a temperature of 1,150° C. to melt only the alloy, while avoiding any melting of the WC particles. An argon gas pressure was applied to the molten alloy containing WC particles to eject it onto the roll rotating at a speed of 2,000 rpm through the end slit of the nozzle. The method is identical to the well-known method for the production of a rapidly-quenched alloy, except for the supply of the WC powder into the nozzle. A ribbon of composite material having a width of 4 mm, a thickness of 30 μm and a length of 5 m was produced.

Figure 2:
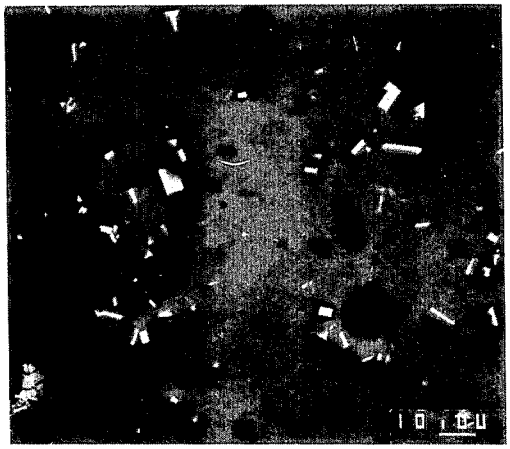
FIG. 2 is a photograph similar to FIG. 1, but showing another material embodying this invention.

Referring to the drawings, FIG. 1 is a scanning electron micrograph showing the surface condition of the material comprising 92% by volume of the alloy and 8% by volume of WC. FIG. 2 is a scanning electron micrograph showing the surface condition of the material comprising 82% by volume of the alloy and 18% by volume of WC.

The WC particles are shown in white. They are dispersed substantially uniformly in the alloy matrix, and no pore is found. No pore was found, either, in that side of the ribbon which had been in contact with the cooling roll, or in its transverse cross section. These findings testified a uniform, three-dimensional dispersion of WC particles in the alloy matrix.

A uniform, three-dimensional dispersion of WC particles in the alloy matrix was also ascertained in the composite material comprising 97% by volume of the alloy and 3% by volume of WC. This material was also free from any pore.

An attempt was made to incorporate WC powder during ingot formation, and found capable of producing similarly excellent composite materials.

The rapidly-quenched alloy forming the matrix was found by X-ray diffraction to be amorphous. The composite material of this invention was found to have excellent mechanical properties. More specifically, it showed an increase in yield stress and Young's modulus with an increase in the volume percentage of WC. These mechanical properties were determined in accordance with simple rules as shown by formulas (1) and (2):

$$E=E_m(1-V_f)+E_pV_f \quad (1)$$

$$\sigma Y=\sigma Y_m[1+V_f(E_p/E_m)-1] \quad (2)$$

where

E, Em and Ep: Young's modulus of the composite material, the alloy matrix and the second-phase particles, respectively;

$\sigma Y$ and $\sigma Y_m$ yield stress of the composite material and the alloy matrix, respectively;

$V_f$: volume percentage of the second-phase particles.

Figure 3:
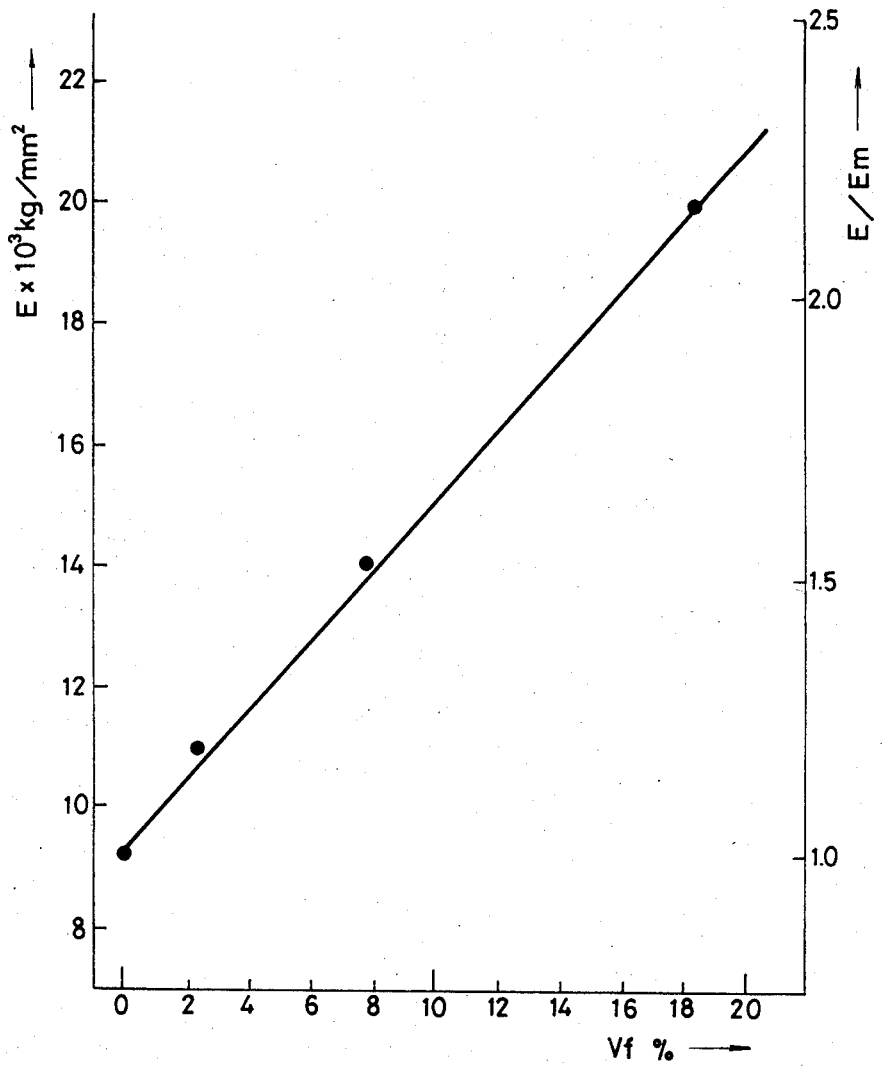
FIG. 3 is a graph showing the Young's modulus of the composite material embodying this invention in relation to the quantity of tungsten carbide therein.

FIG. 3 is a graph showing an increase in the Young's modulus (E) of the composite material with an increase in the volume percentage ($V_f$) of WC according to formula (1). This graph shows the changes found in the Young's modulus (E) of the composite material and the $E/E_m$ ratio in accordance with the change in the volume percentage ($V_f$) of WC when the WC particles had a Young's modulus ($E_p$) of 68,000 kg/mm$^2$. Broken WC particles were found at the corresponding points of the fracture surfaces formed by a tensile test. This testified the formation of a final load bearing area by WC particles after the fracture of the amorphous alloy matrix without any cracking in the interface between the matrix and the WC particles. This indicates a very high interfacial strength between the matrix and the WC particles.

A further advantage of the composite material according to this invention resides in the high toughness which it possesses in addition to high strength. The composite material of this invention having a WC content up to, say, 20% by volume could be bent completely. The high strength and toughness of the material according to this invention are apparently due to a uniform, three-dimensional dispersion of WC particles in the rapidly-quenched alloy matrix, and a structure which is free from any pore.

EXAMPLE 2

Composite materials of the following compositions were produced by repeating substantially the method described in EXAMPLE 1:

$(Ni_{78}Si_{10}B_{12})_{90}(ThO_2)_{10}$ $(Ni_{78}Si_{10}B_{12})_{80}(ThO_2)_{20}$

They were each prepared in the form of a ribbon having a width of 4 mm, a thickness of 30 μm and a length of 5 m. The $ThO_2$ particles had an average diameter of 2 μm. The inspection of each material by a scanning electron microscope revealed a uniform, three-dimensional dispersion of $ThO_2$ particles in the superquenched alloy matrix, and also indicated that it had no pore. The matrix was found by X-ray diffraction to be amorphous. The excellent aspects of the mechanical properties of the alloy matrix and the second-phase particles manifested themselves in the composite material, and imparted high levels of strength and toughness thereto, as in the case of EXAMPLE 1. The yield stress and Young's modulus of the composite materials according to this example were also found to increase in accordance with the simple rules shown in EXAMPLE 1.

EXAMPLE 3

Composite materials of the following compositions were produced in the shape of a wire having a diameter of 150 μm and a length of 4 m by the well-known spinning method employing a rotating solution:

$(Fe_{75}Si_{10}B_{15})_{95}(TiC)_5$ $(Fe_{75}Si_{10}B_{15})_{90}(TiC)_{10}$

Water was used as a coolant. The rotary drum was rotated at a speed of 1,000 rpm, and argon gas was supplied at a rate which was about 0.6 to 0.9 time faster than the rotating speed of the drum. The TiC particles had an average diameter of 1 μm. The inspection of each composite material by a scanning electron microscope revealed a uniform, three-dimensional dispersion of TiC particles in the rapidly-quenched alloy matrix, and also ascertained that it had no pore. The matrix was found by X-ray diffraction to be amorphous. The composite materials were excellent in mechanical properties, especially in yield strength. They showed a yield strength of 500 kg/mm$^2$ which is by far greater than that of the presently available strongest piano wire. Their yield stress and Young's modulus were found to increase in accordance with the simple rules shown in EXAMPLE 1.

EXAMPLE 4

Composite materials of the following compositions were produced in the shape of a ribbon having a width of about 4 mm, a thickness of about 30 μm and a length of 3 m by repeating the method described in EXAMPLE 1:

$(Ni_{78}Si_{10}B_{12})_{90}(BN)_{10}$ $(Ni_{78}Si_{10}B_{12})_{80}(BN)_{20}$

The BN particles had an average diameter of 1 μm. The inspection of each composite material by a scanning electron microscope revealed a uniform, three-dimensional dispersion of BN particles in the rapidly-quenched alloy matrix, and a composite structure which was free from any pore. The matrix was found by X-ray diffraction to be amorphous. The excellent aspects of the mechanical properties of the alloy matrix and the BN particles manifested themselves in the composite material, and imparted high levels of strength and toughness thereto, as in the case of EXAMPLE 1. Their yield stress and Young's modulus were found to increase in accordance with the simple rules set forth in EXAMPLE 1.

EXAMPLE 5

Composite materials of the following compositions were produced in the shape of a ribbon having a width of 4 mm, a thickness of 30 μm and a length of 3 m by repeating the method described in EXAMPLE 1:

$(Cu_{60}Zr_{40})_{90}(SiC)_{10}$ $(Cu_{60}Zr_{40})_{70}(SiC)_{30}$

The SiC particles had an average diameter of 3 μm. The inspection of each composite material by a scanning electron microscope revealed a uniform, three-dimensional dispersion of SiC particles in the rapidly-quenched alloy matrix, and a composite structure which was free from any pore. The matrix was found by X-ray diffraction to be amorphous. The matrix in the composite materials of this example is not of the type employed in EXAMPLES 1 to 3, but an amorphous metal-to-metal alloy not containing any semimetal. Thus, this example shows a different aspect of this invention. The composite materials thus obtained were superior in yield stress and tensile strength to the conventional amorphous alloy composed of 60 atom % of Cu and 40 atom % of Zr.

EXAMPLE 6

A composite material comprising 98% by volume of an alloy consisting of 82 atom % of Fe and 18 atom % of B, and 2% by volume of iron particles was produced by repeating the method described in EXAMPLE 1. The iron particles had an average diameter of 5 μm. The inspection of the composite material by a scanning electron microscope revealed a uniform, three-dimensional dispersion of iron particles in the rapidly-quenched alloy matrix. The matrix was an Invar alloy. This amorphous Fe-B alloy has a high saturated magnetic flux density, and is one of the promising materials for transformers. The magnetic properties required of a transformer material include a high saturated magnetic flux density, a small iron loss, a high permeability, a low magnetic strain, and a low level of magnetic deterioration. The amorphous transformer material is superior to silicon steel sheet by virtue of its small iron loss and high permeability, while a further improvement is still required in the other aspects.

The composite material containing 1% by volume of iron particles showed a saturated magnetic flux density which was 3% higher than that of the amorphous alloy forming the matrix.

EXAMPLE 7

A composite material comprising 80% by volume of an alloy consisting of 45 atom % of Zr, 40 atom % of Nb and 15 atom % of Si, and 20% by volume of NbN powder was produced as will hereinafter be set forth. The NbN powder had an average particle diameter of 3 μm. A Zr—Nb—Si alloy ingot, which had been prepared by arc melting, and NbN particles were arc melted at 1,650° C. to prepare a mixture of the alloy and NbN particles. The NbN particles were not in the molten state. This high-melting mixture was melted by high-frequency levitation in an argon gas atmosphere, and the molten mixture was subjected to liquid quenching by the single-roll method, whereby the composite material was produced.

The inspection of the composite material by a scanning electron microscope revealed a uniform, three-dimensional dispersion of NbN particles in the rapidly-quenched alloy matrix, and a composite structure which was free from any pore. The matrix was found by X-ray diffraction to be amorphous.

The matrix alloy was eluted from the composite material by employing a 1% aqueous solution of fluoric acid to extract only the NbN particles. The NbN particles were subjected to X-ray diffraction by the Debye-Scherrer method, and their structure was fixed as being a face-centered cubic structure of the NaCl type. The NbN particles which remain stable at ordinary room temperature have a hexagonal lattice structure, and it is generally believed that a face-centered cubic lattice structure which remains stable at a temperature above 1,275° C. cannot be cooled to ordinary room temperature at an ordinary quenching rate. The composite material of this invention, however, contains in the rapidly-quenched alloy matrix the NbN particles having a face-centered cubic lattice structure which they usually cannot take at ordinary room temperature. NbN is a superconductive material having a high critical temperature when it has a phase of the NaCl type. The matrix in the composite material of this invention is a superconductive material having a critical temperature of about 3 K. Therefore, the composite material was expected to be a good superconductor, and in fact, it showed a critical temperature of about 12 K which was 9 K higher than that of the amorphous Zr—Nb—Si alloy not containing any NbN particle.

According to this example, the second-phase particles are rapidly-quenched in the solid state, and can, therefore, remain metastable at ordinary room temperature. Thus, the composite material of this invention is novel in that the matrix is composed of a rapidly-quenched alloy, and the second-phase particles are incorporated in a solid phase at a high temperature prior to quenching, and in a metastable phase at ordinary room temperature.

EXAMPLE 8

This example differs from the foregoing examples in that it employs a crystalline alloy in the matrix. Composite materials of the following compositions were produced by dispersing WC particles in a non-equilibrium austenite:

$(Fe_{89.4}Mo_9C_{1.6})_{98}(WC)_2$ $(Fe_{89.4}Mo_9C_{1.6})_{95}(WC)_5$ $(Fe_{89.4}Mo_9C_{1.6})_{90}(WC)_{10}$

The inspection of each composite material by a scanning electron microscope revealed a uniform, three-dimensional dispersion of WC particles in the rapidly-quenched alloy matrix, and a composite structure which was free from any pore. The matrix was ascertained as being a single non-equilibrium γ-austenite phase having an ultrafine crystal grain structure. The non-equilibrium γ-austenite forming the matrix is a crystalline alloy is higher in thermal stability than an amorphous alloy. It is strong and tough, though it is a crystalline alloy, but its strength and toughness are lower than those of an amorphous alloy. Its strength is in the range of, say, 100 to 150 kg/mm$^2$, or about a half of that of an amorphous alloy. The composite materials containing 5% or 10% by volume of WC have a strength of 200 to 300 kg/mm$^2$ which is comparable to that of an iron-based amorphous alloy. The γ-austenite matrix provides higher thermal stability than an amorphous alloy matrix.

What is claimed is:

1. A composite alloy produced by rapid quenching comprising a matrix composed of a rapidly quenched amorphous alloy, and particles of a second phase substance having a melting temperature higher than that of the matrix, which particles are coercively and uniformly three-dimensionally dispersed in the matrix without the formation of pores after rapid quenching, wherein the second phase substance is NbN powder which has a face centered cubic lattice structure at ordinary room temperature and is approximately 20% by volume of the composite alloy, and said matrix is an amorphous Zr—Nb—Si alloy having superconductive properties and a high critical temperature of about 12 K.

* * * * *